US005456652A

United States Patent [19]

Eberle

[11] Patent Number: 5,456,652

[45] Date of Patent: Oct. 10, 1995

[54] ROTOR FOR A SWIVELING BEAKER CENTRIFUGE

[75] Inventor: Gunter Eberle, Tuttlingen, Germany

[73] Assignee: Firma Andreas Hettich, Tuttlingen, Germany

[21] Appl. No.: 200,283

[22] Filed: Feb. 22, 1994

[30] Foreign Application Priority Data

Feb. 24, 1993 [DE] Germany ..... 43 05 581.8

[51] Int. Cl.[6] ..... B04B 5/02

[52] U.S. Cl. ..... 494/20

[58] Field of Search ..... 494/12, 16, 20, 494/31, 33, 85; 210/380.1

[56] References Cited

U.S. PATENT DOCUMENTS

| | | | |
|---|---|---|---|
| 484,685 | 10/1892 | Stoddard | 494/20 X |
| 486,390 | 11/1892 | Berg | 494/20 X |
| 3,420,437 | 1/1969 | Blum et al. | 494/20 |
| 3,781,120 | 12/1973 | Engelhardt | 494/20 X |
| 3,877,634 | 4/1975 | Rohde et al. | 494/20 X |
| 4,431,423 | 2/1984 | Weyant, Jr. | 494/20 |
| 4,589,864 | 5/1986 | Cole | 494/20 |

FOREIGN PATENT DOCUMENTS

| | | |
|---|---|---|
| 0025945 | 4/1981 | European Pat. Off. . |
| 0088425 | 9/1983 | European Pat. Off. . |
| 643836 | 4/1937 | Germany . |
| 1698262 | 12/1971 | Germany . |
| 2145023 | 3/1972 | Germany . |
| 2425165 | 12/1974 | Germany . |
| 3118367 | 12/1982 | Germany . |
| 8903511 | 2/1990 | Germany . |
| 534545 | 4/1973 | Switzerland . |

*Primary Examiner*—Charles E. Cooley

*Attorney, Agent, or Firm*—Brown, Martin, Haller & McClain

[57] ABSTRACT

A rotor for a swivel beaker centrifuge with mountings for several swivel beakers ensures that the rotor is formed essentially as a horizontal disk and recesses have been prepared in the disk in which arms of the swivel beaker engage, whereby the centrifugal force acting on the swivel beakers is transferred with its stress from the arms to the external radial edge of the respective slit in the rotor disk.

10 Claims, 5 Drawing Sheets

ROTOR FOR A SWIVELING BEAKER CENTRIFUGE

BACKGROUND OF THE INVENTION

The invention relates to a rotor for a swiveling breaker centrifuge with mountings for several swivel beakers.

A rotor of this type is described in German patent document No. DE 89 03 511 U1 of the same Applicant. In this rotor the swiveling beakers have been formed as test tubes so that these are filled directly with a test fluid, and for the rest they consist of plastic. Recesses lying one after the other radially in the front and the rear radial direction have been made in the rotor, which is formed essentially as a horizontal disk, where these recesses should make possible a swiveling of the swiveling beaker into these recesses when the swiveling beakers are swinging out. When they are swinging out they place the known swiveling beakers with their bottom areas in a surrounding radial external flange of the rotor, whereby the handle-like arms serving as swivel bearing and engaging in assigned recesses of the disk no longer have to act as transferring the load. Thus it involves swivel bearings that serve only to secure the bearing and the rotation of the swiveling beakers that swing out and which no longer have to transfer additional centrifugal forces at least not when the required speed of rotation is reached, because this force is transferred over the bottom area of the swiveling beaker to the rotating flange of the rotor lying radially on the outside.

With the known rotor there was thus the advantage that relatively inexpensive specimen vessels could be used, which could be suspended in the rotor with their handle-like, free arms without additional aids.

Because of the necessity for transferring the load of the centrifugal force acting on the swiveling beakers to the radial flange of the rotor lying outside, the result was, however, an increased manufacturing cost for the rotor.

SUMMARY OF THE INVENTION

The invention is therefore based on the task of developing a rotor of the type cited at the beginning in such a way that the rotor itself can be formed simply and high centrifugal forces can still be transferred from the swiveling beakers to the rotor.

According to one aspect of the present invention, a rotor assembly for a centrifuge is provided which comprises a horizontal rotor disk having an outer peripheral edge and a plurality of spaced slits extending at spaced intervals around the disk at a location spaced inwardly from the peripheral edge, and a plurality of swivel beakers each having a longitudinal axis and an arm for swivel engagement through a respective slit, each arm having a first portion extending outwardly in a direction transverse to the longitudinal axis and a second portion extending downwardly at an angle to the first portion for extending downwardly through a respective slit, the second portion extending at an angle to the longitudinal axis along at least part of its length.

In the rest position, each beaker is suspended via its arm from the disk in a vertical or outwardly angled rest position, and swivels outwardly as a result of centrifugal force as the rotor disk rotates. With this arrangement, it is no longer necessary to provide a load carrying, radial flange lying outside the rotor for carrying the centrifugal force of the swivel beakers, as was the case in the rotor assembly described in German DE 89 03 511 U1 referred to above.

Preferably, each arm includes an annular metal part which is embedded in a collar portion of the respective beaker adjacent the open end of the beaker, and the first portion of the arm extends radially from the annular part outwardly from the beaker. The entire arm is preferably formed from a single piece of metal which is suitably shaped. With this arrangement, the centrifugal force acting on each swivel beaker is transferred directly to the arm. Each arm engages the respective slit in the rotor to support the swivel beaker and allow it to swivel outwardly.

This results in an extremely simple structure for the rotor because it is only necessary to provide a disk with slits through which the individual arms of the carrier parts engage the respective swiveling beakers.

The arms are preferably placed at an angle and are dimensioned (length, width and thickness as well as the angular position with respect to the longitudinal axis of the jacket of the swiveling beaker) so that in a first preferred practical example the result is an approximate weight balance for the swiveling beaker when the rated speed of the rotor is reached. This means that the centrifugal force exerted by the arm and the centrifugal force of the jacket of the swiveling beaker on the slit of the rotor are approximately equal when the rated speed of the centrifuge is reached so that the swiveling beaker assumes a horizontal swivel position.

In a second practical example an intentional imbalance between the centrifugal force exerted by the arm on the slit results as compared to the centrifugal force exerted by the jacket on the slit so that an intentional inclined position of the entire swiveling beaker is obtained when the rated speed of the rotor is reached.

In a practical example the length of the arm is selected such that the free lower part of the arm terminates approximately at the bottom area of the jacket of the swiveling beaker so that the swiveling beaker can be placed free on an assembly level and the arm thus serves as support leg.

In a different development the arm is offset, whereby an approximately Z shape is preferred so that the free, offset end of the arm touches certain striking surfaces of the disk-shaped rotor when the swiveling beakers swing out.

In this way the angular position of the swiveling beaker swinging out can be limited.

In another development of the invention the arm is offset so that in the rest position of the suspension gear, that is, with the rotor at rest, the free outer end of the arm rests on the rotor head in order thus to define the swiveling position of the swivel beaker when the rotor is at rest.

The present invention will be better understood from the following detailed description of some preferred embodiments of the invention, taken in conjunction with the accompanying drawings, in which like reference numerals refer to like parts, and in which:

DETAILED DESCRIPTION OF THE PREFERRED EMBODIMENT

Figure 1:
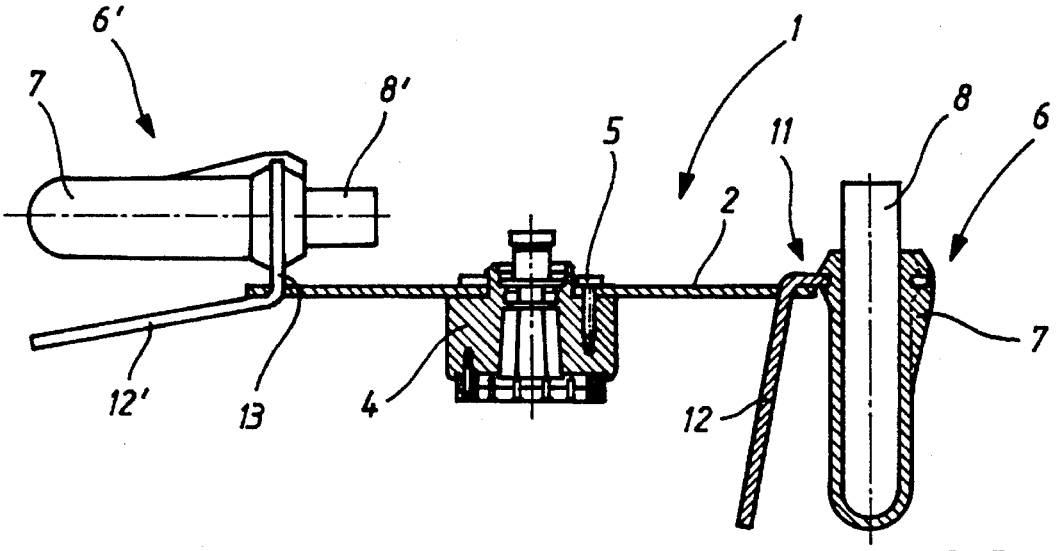
FIG. 1 shows a section through a rotor in the operating and in the rest position.
Figure 2:
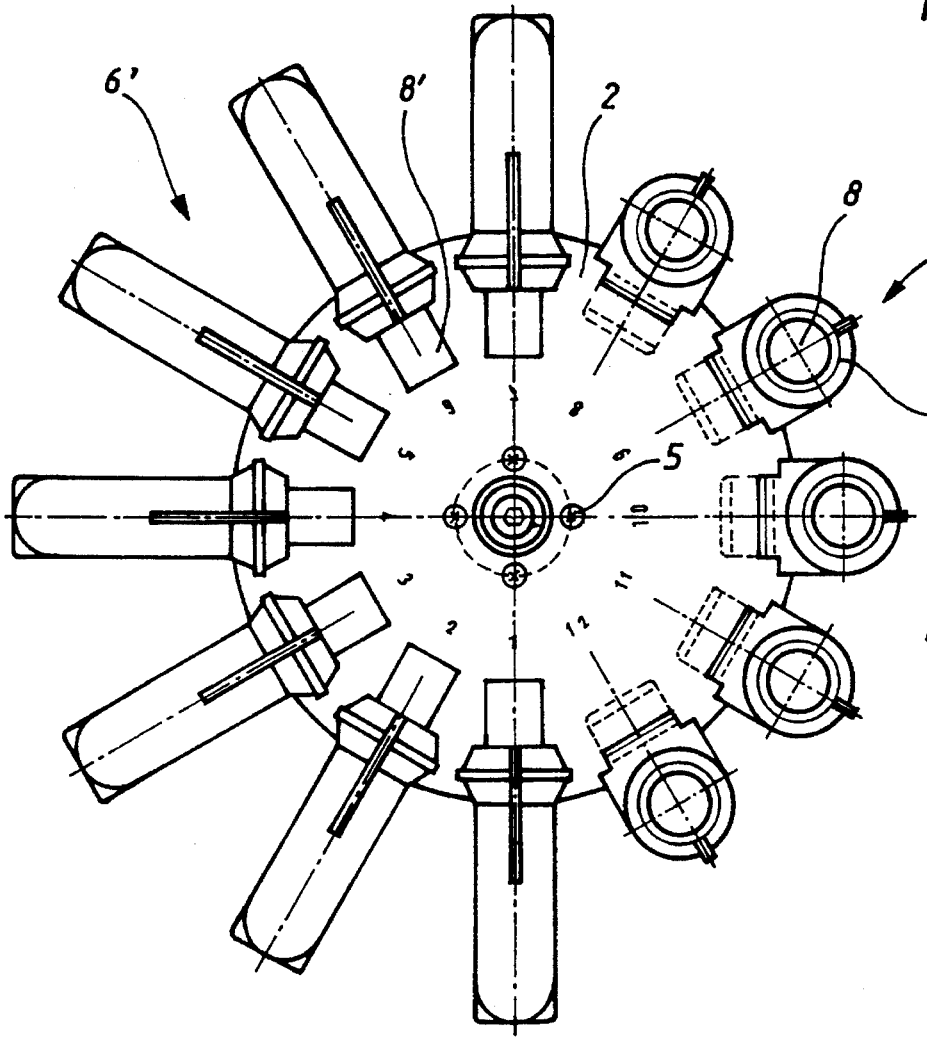
FIG. 2 shows a top view of the arrangement according to FIG. 1.

FIGS. 1 and 2 of the drawings illustrate a rotor assembly 1 according to a first embodiment of the invention comprising a rotor disk 2 and a plurality of swivel beakers 6 suspended from the periphery of the disk via carrier parts or arms 11. The disk is preferably of a high strength, rust-free metal, for example a nickel-chromium alloy. The rotor disk is illustrated in more detail in FIGS. 3 and 4, while FIGS. 5–10 are details of one example of a beaker.

The disk 2 is connected in a known way by means of screws 5 to a rotor head 4, which is connected through the shown means of attachment to the drive shaft of a drive motor, which is not shown in more detail.

Furthermore, the disk 2 is equipped with a center recess 3, through which parts of the rotor head 4 engage.

Figure 3:
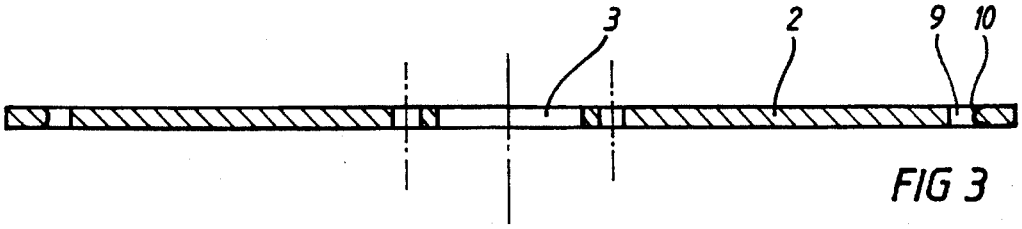
FIG. 3 shows a section through the rotor disk.
Figure 4:
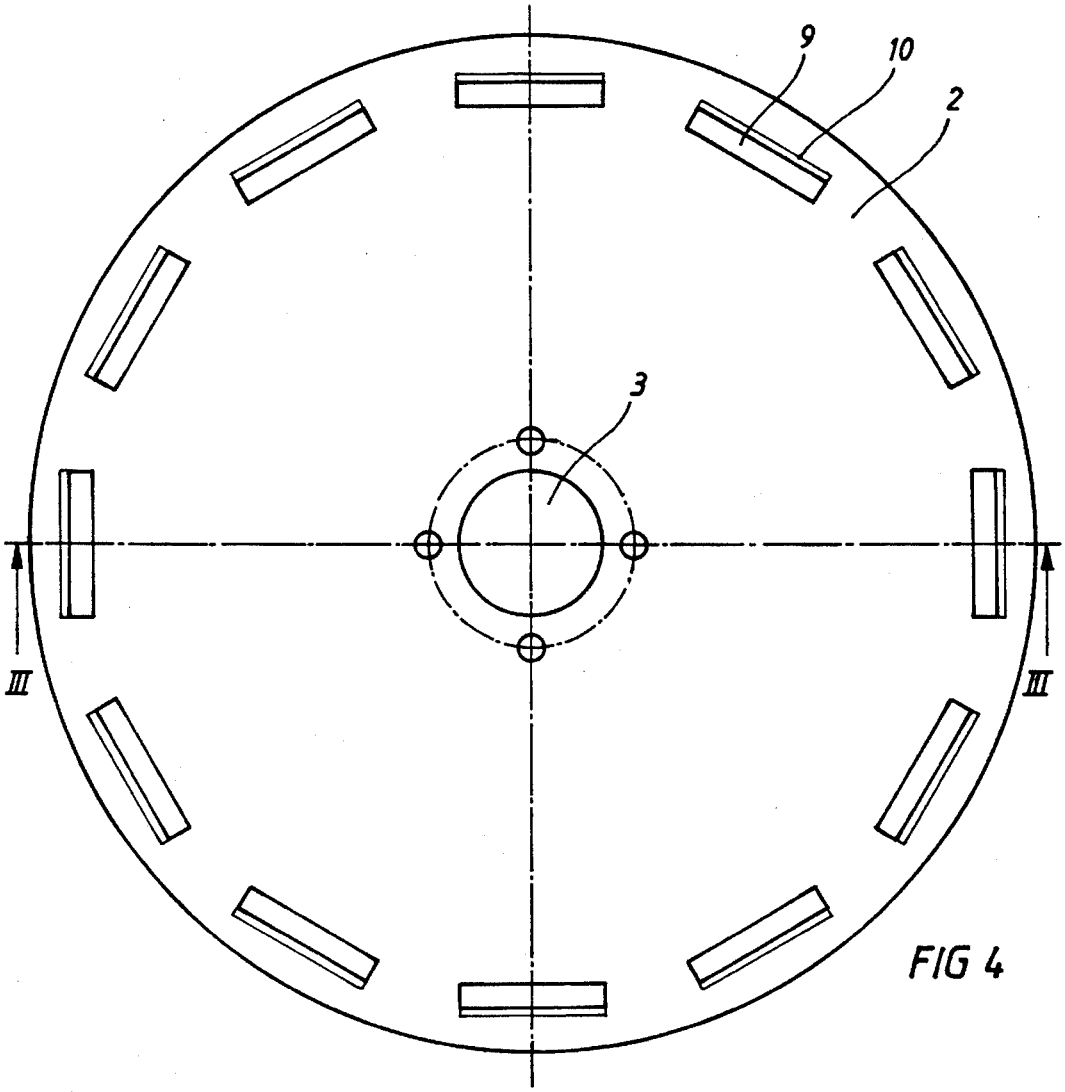
FIG. 4 shows a top view of the rotor disk.

According to FIGS. 3 and 4, slits 9 have been prepared in the disk 2 uniformly distributed around the circumference of the rotor, whereby preferably the edges of the slits 10 lying radially on the outside have been formed with approximately round profiles in order to form a swivel bearing for the carrier parts 11 of the swivel beaker 6 that swing out.

Each swivel beaker 6 consists of a jacket 7, which preferably consists of a plastic material, in the upper, collar-shaped expanded edge of which the carrier part 11 is embedded. The carrier part 11 consists of a ring 14 of a high-strength metal material, a first arm portion 13 formed in one piece with ring 14 and projecting transversely outwardly from the beaker, and a second, integral arm portion 12 bent downwardly from arm portion 13 at an angle to the central axis of beaker jacket 7. The arm 11 is preferably formed from a single piece of metal suitably shaped to form ring 14, first portion 13 and second portion 12.

A rib 15 has been formed on the side of the jacket 7 lying opposite the arm 12 in order to ensure stabilization of the jacket 7 in this area.

A test tube 8, which accepts the sample fluid, is inserted in the jacket 7.

The jacket 7 is matched to the test tube 8 depending upon the dimensioning of the test tube (filler volume, length, diameter, etc.).

Figure 7:
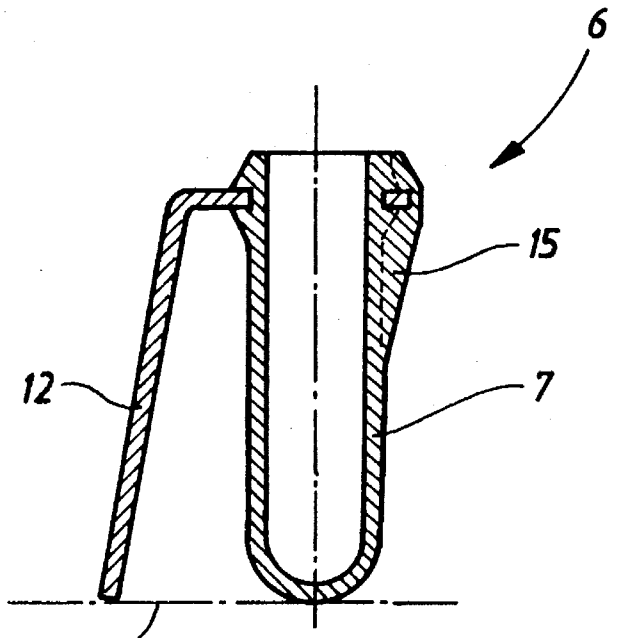
FIG. 7 shows a section through the swiveling beaker according to FIG. 5.
Figure 8:
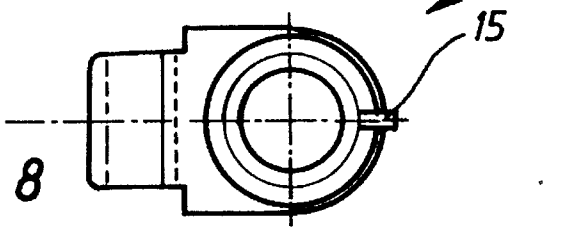
FIG. 8 shows a top view of the swiveling beaker according to FIG. 5.
Figure 6:
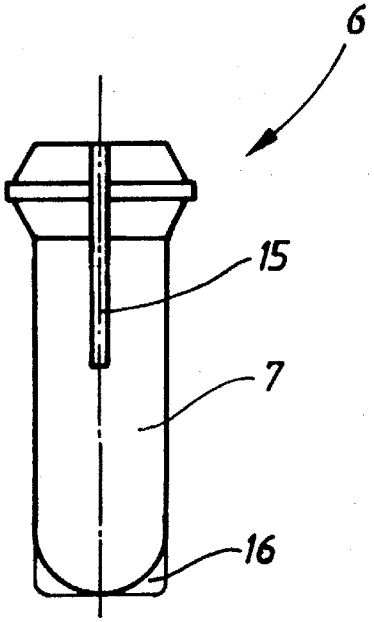
FIG. 6 shows the side view rotated by 90°.
Figure 5:
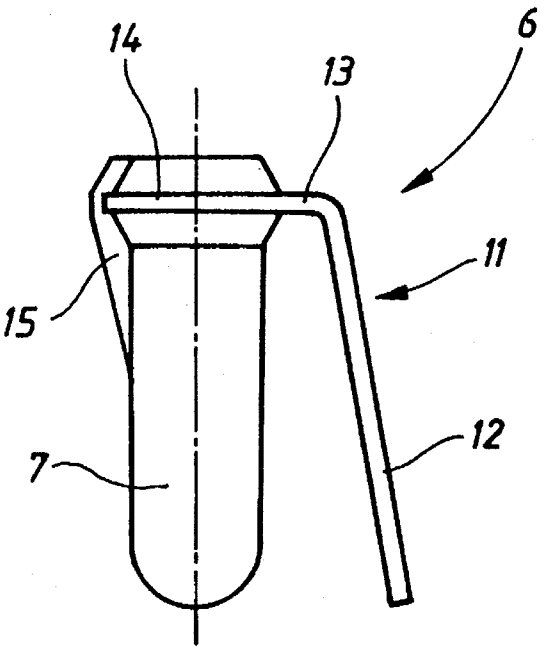
FIG. 5 shows a side view of a first practical example of a swiveling beaker.
Figure 9:
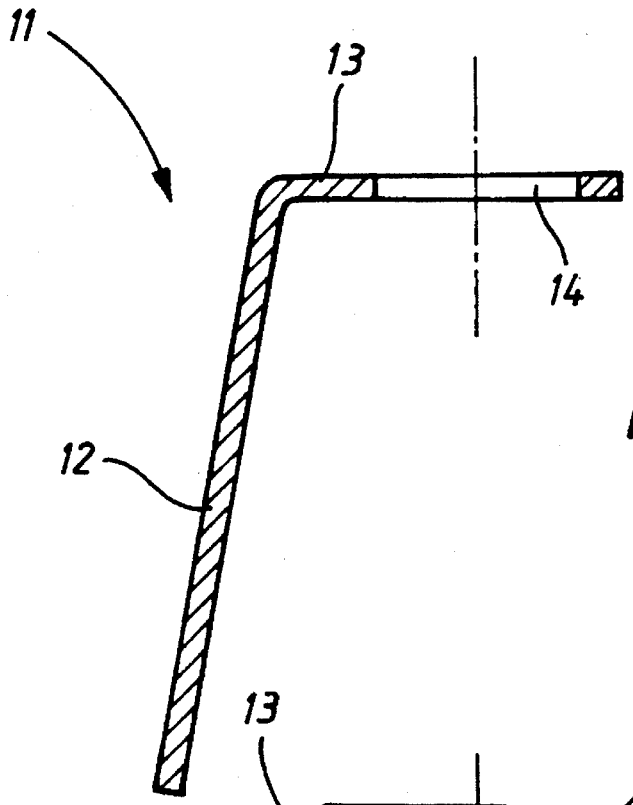
FIG. 9 shows a section through the carrier part.
Figure 10:
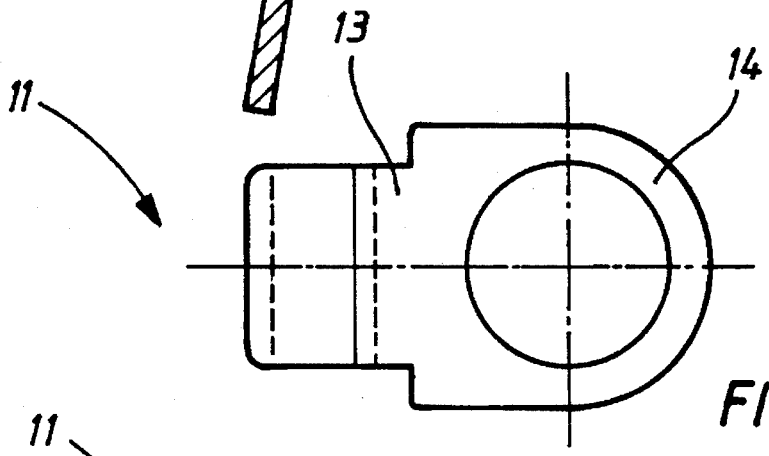
FIG. 10 shows a top view of the carrier part.
Figure 11:
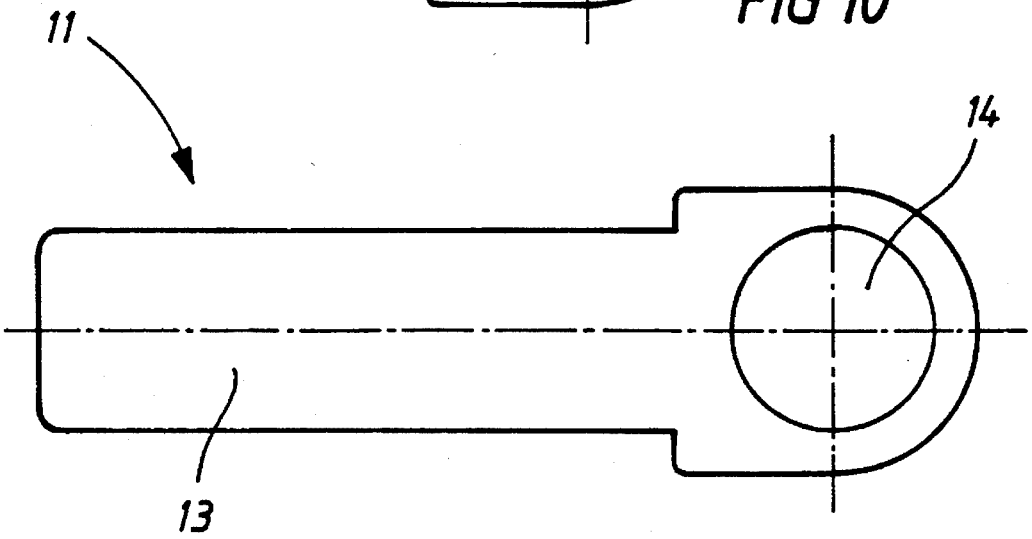
FIG. 11 shows the carrier part in top view before applying a bend.

In a preferred practical example according to FIGS. 5 through 7, the free end of the arm 12 is selected so long that it forms roughly a line 17 with the bottom area of the jacket 7, whereby at the bottom area of the jacket one additional rib 16 can also be formed. In this way the arm 12 serves as support base for the swivel beaker 6, which thereby can be placed free on a support surface.

In the rest condition of the rotor assembly 1 all swivel beakers 6 engage the assigned slits 9 in the disk 2 with their arms 12.

When the rotor reaches the nominal speed of rotation, the swivel beakers 6 are deflected to the outside into swivel orientation 6', in which the test tube 8 assumes the substantially horizontal orientation 8' and the downwardly inclined portion 12 of the arm assumes the orientation 12', in which it acts as a stop to prevent further rotation of breaker 6, as shown in FIGS. 1, 2 on the left side. The edges 10 of the slits 9 hereby serve as swivel bearing, and the swinging out takes place in the transition range between the first arm portion 13 and the downwardly bent second arm portion 12 of the carrier part 11.

In the invention it is consequently important that the carrier part 11 transfers the stress of the centrifugal force to the slit 9 through the edge 10 to the disk 2. The rotor can thus be made most simple and no expensive striking surface is required on the rotor in order to accept the centrifugal forces.

Figure 12:
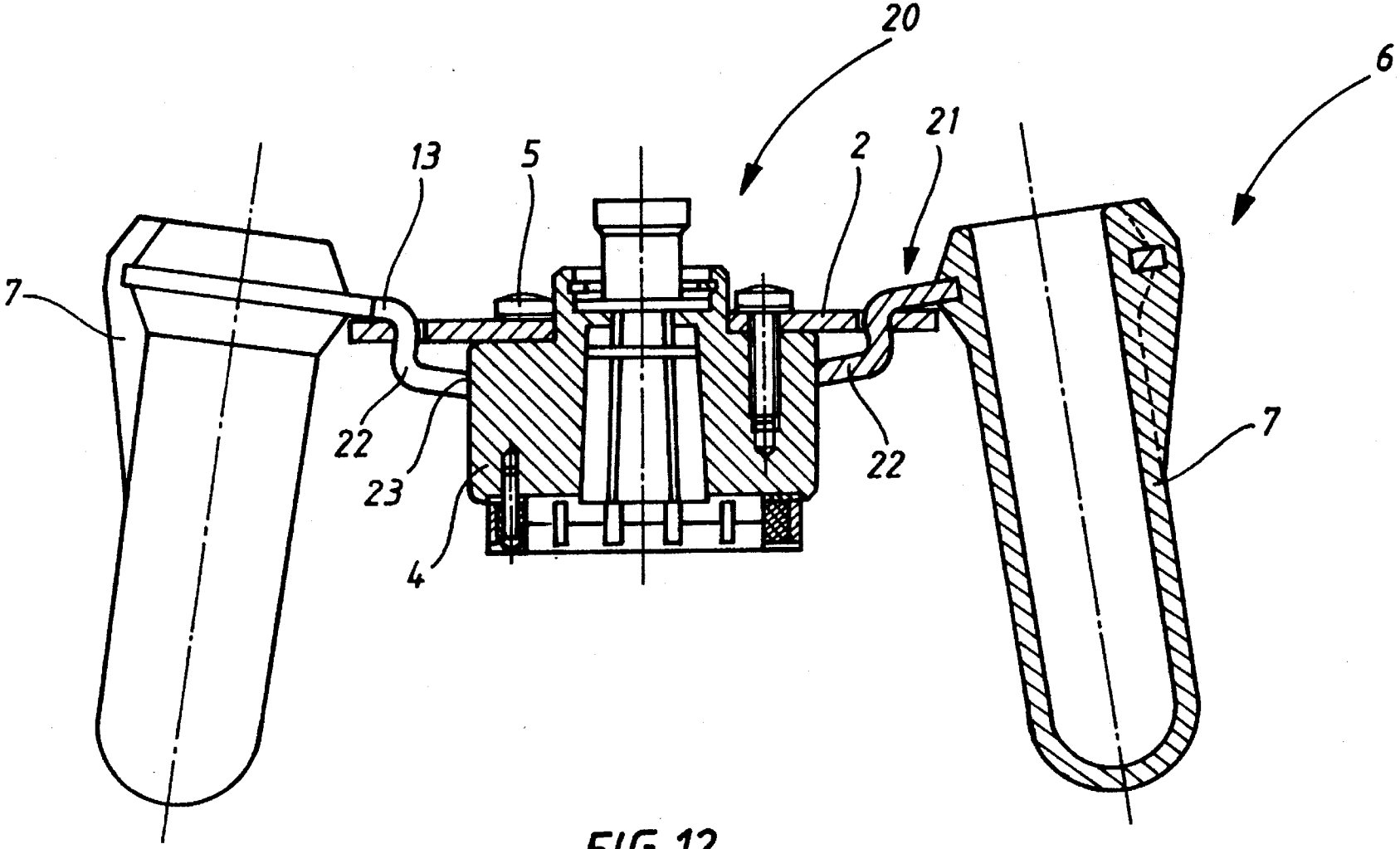
FIG. 12 shows a section through a second embodiment of a rotor.

FIG. 12 shows an additional rotor 20, which holds the swivel beakers 6, which are connected with other formed carrier parts 21. Each carrier part hereby exhibits an arm 22, which is offset in the approximate shape of a Z and which in the rest position of the swivel beaker 6 rests with its front edge 23 on the rotor head 4. In this way in the rest position of the rotor a definite, desired inclined position of the swivel beaker is achieved, which can be adjusted by the shaping of the arm 22.

Conversely, a swivel position can also arbitrarily be adjusted by shaping the arm 22 with the swivel beaker swung out. Then the front edge 23 of the arm 22 hereby strikes (not shown) assigned striking surfaces of the rotor.

I claim:

1. A rotor assembly for a centrifuge, comprising:

a rotor comprising a horizontal disk having an outer edge and a plurality of spaced slits extending at spaced intervals around the disk at a location spaced inwardly from said outer edge;

a plurality of tubular swivel beakers, each beaker having a longitudinal axis, an upper open end, and an arm for swivel engagement in a respective one of the rotor slits, the arm having a first portion extending transversely outwardly from the beaker for engaging over the outer edge of the disk up to the respective slit, and a second portion bent at an angle to the first portion for extending downwardly through the respective slit, the second portion extending at an angle greater than 0° to the longitudinal axis of the beaker along at least part of its length;

whereby each swivel beaker is normally suspended substantially vertically from said disk when said disk is at rest and is arranged to swivel outwardly as a result of centrifugal force when said disk rotates;

each swivel beaker being of plastic material and having an upper collar portion adjacent said upper open end, and each arm being of metal material and including a ring portion embedded in the upper collar portion of the respective beaker, said first portion of the arm extending radially outwardly from said ring portion and collar portion.

2. The assembly as claimed in claim 1, wherein each swivel beaker has a lower, closed end and the respective arm has a free lower end which is co-planar with the lower closed end of the beaker.

3. The assembly as claimed in claim 1, wherein the rotor has a rated speed of rotation whereby each beaker swivels outwardly into a horizontal orientation when said rotor rotates at its rated speed.

4. The assembly as claimed in claim 1, wherein the second portion of each arm has a length less than the axial length of the respective beaker.

5. The assembly as claimed in claim 1, wherein each swivel beaker has a closed lower end and comprises container means for receiving a test fluid.

6. The assembly as claimed in claim 1, wherein each swivel beaker comprises means for holding a test tube.

7. The assembly as claimed in claim 1, wherein each slit has an inner edge and an outer edge, the outer edge having a curved profile and comprising a swivel bearing for the respective arm.

8. A rotor assembly for a centrifuge, comprising:

a rotor comprising a horizontal disk having a circular outer peripheral edge and a plurality of spaced slits extending at spaced intervals around the disk at a location adjacent said peripheral edge; and a plurality of swivel beakers, each beaker comprising a tubular member having an open upper end and a longitudinal axis, and a handle arm projecting transversely outwardly from the beaker for engagement in a respective one of the rotor slits, the handle arm being Z-shaped.

9. The assembly as claimed in claim 8, wherein the rotor has a central rotor head, the rotor head having a central axis defining the axis of rotation of the rotor, and each handle arm has a free end comprising means for engagement with said rotor head in a rest position of the respective swivel beaker.

10. The assembly as claimed in claim 9, wherein each handle arm comprises means for holding the respective swivel beaker at an outwardly inclined angle relative to said central axis in said rest position.

* * * * *

UNITED STATES PATENT AND TRADEMARK OFFICE

CERTIFICATE OF CORRECTION

PATENT NO. : 5,456,652

DATED : October 10, 1995

INVENTOR(S) : GUNTER EBERLE

It is certified that error appears in the above-indentified patent and that said Letters Patent is hereby corrected as shown below:

COLUMN 1, LINE 7, CHANGE "BREAKER" TO --BEAKER--; AND

COLUMN 4, LINE 6, CHANGE "BREAKER" TO --BEAKER--.

Signed and Sealed this

Ninth Day of April, 1996

*Attest:*

*Attesting Officer*

BRUCE LEHMAN

*Commissioner of Patents and Trademarks*